United States Patent [19]

Lifton

[11] 4,153,957

[45] May 15, 1979

[54] CONVERTIBLE ADULT AND INFANT TOILET SEAT

[76] Inventor: Harold Lifton, 600-3 Bay Chester Ave., Bronx, N.Y. 10475

[21] Appl. No.: 853,336

[22] Filed: Nov. 21, 1977

[51] Int. Cl.[2] ..... A47K 13/06

[52] U.S. Cl. ..... 4/237; 4/239

[58] Field of Search ..... 4/235, 239, 234, 237, 4/236

[56] References Cited

U.S. PATENT DOCUMENTS

| | | | |
|---|---|---|---|
| 2,692,992 | 11/1954 | Thimmes et al. | 4/235 |
| 2,804,630 | 9/1957 | Gould | 4/239 |
| 3,341,867 | 9/1967 | Keen | 4/239 |

FOREIGN PATENT DOCUMENTS

| | | | |
|---|---|---|---|
| 454432 | 10/1926 | Fed. Rep. of Germany | 4/235 |

*Primary Examiner*—Richard E. Aegerter
*Assistant Examiner*—L. Footland
*Attorney, Agent, or Firm*—Howard I. Podell

[57] ABSTRACT

A convertible toilet seat which includes a main seat and a built-in infant seat of smaller diameter in three segments sandwiched therein in slots in the main seat and an actuating rod for moving the infant seat in and out of position. The segments are mounted in a rectangular frame.

3 Claims, 3 Drawing Figures

CONVERTIBLE ADULT AND INFANT TOILET SEAT

FIELD OF THE INVENTION

This invention relates generally to a convertible adult and infant toilet seat adjustable from one to the other.

DESCRIPTION OF THE PRIOR ART

The prior art, as exemplified by U.S. Pat. Nos. 3,601,822; 3,205,510; 2,584,141; 2,517,755; 2,294,366; and 2,047,480 is generally illustrative of the pertinent art but the aforementioned patents are non-applicable to the present invention. While the prior art expedients are generally acceptable for their intended purposes only, they have not proven entirely satisfactory in that they are either complex and expensive to manufacture, or inconvenient to use, or to operate. As a result of the shortcomings of the prior art, typified by the above, there has developed a substantial need for improvement in this field.

The principal object of this invention is to provide a device or article of this character which combines simplicity, strength and durability in a high degree, together with inexpensiveness of construction so as to encourage widespread use thereof.

Other objects of this invention will in part be obvious and in part hereinafter pointed out.

The invention accordingly consists in the features of construction, combinations of elements, and arrangement of parts which will be exemplified in the construction hereinafter described, and of which the scope of application will be indicated in the following claims.

SUMMARY OF THE INVENTION

This invention resides in a convertible toilet seat which includes a main seat and a built-in infant seat of smaller diameter in three segments sandwiched therein in slots in the main seat and an actuating rod for moving the infant seat in and out of position. The segments are mounted in a rectangular frame.

BRIEF DESCRIPTION OF THE DRAWING

In the accompanying drawing, in which is shown one of the various possible illustrative embodiments of this invention, wherein like reference character identify the same or like parts.

DESCRIPTION OF THE PREFERRED EMBODIMENT

Figure 1:
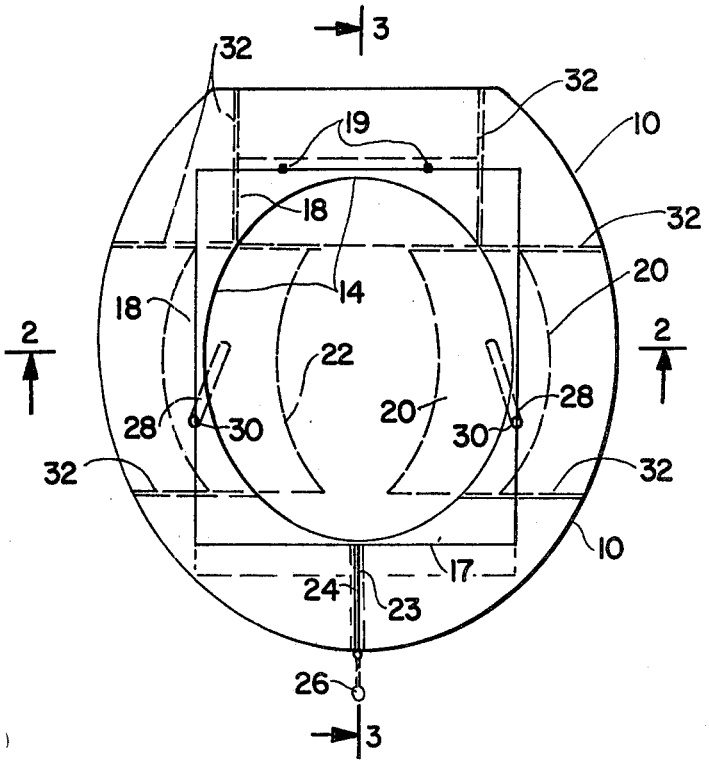
FIG. 1 is a top planar, partly sectional view of the adjustable toilet seat of the invention.
Figure 2:
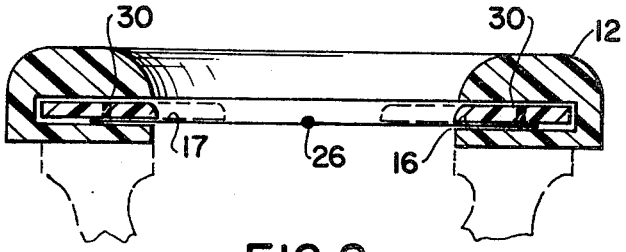
FIG. 2 is a cross-sectional view taken along line 2—2 of FIG. 1.
Figure 3:
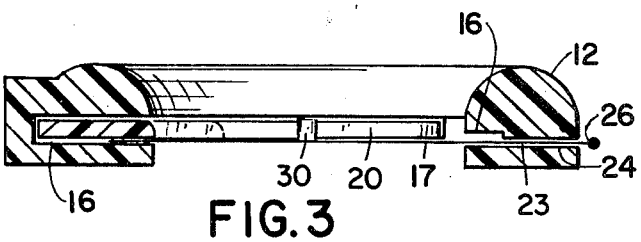
FIG. 3 is a cross-sectional view taken along line 3—3 of FIG. 1, but not to the scale of FIG. 1 or FIG. 2.

With reference to the drawing, there is shown and illustrated an adjustable toilet seat constructed in accordance with the principles of the invention and designated generally by reference character 10. The illustrated tangible embodiment of the invention includes a main seat 12 made of wood or molded from suitable plastic and having a central circular opening 14 therein shown by solid lines in the drawing. Seat 12 is hollowed out about opening to form a rectangular space 16. Fitting in space 16 and slidable therein is a rigid rectangular wire frame 17. Space 16 extends from $1\frac{3}{4}$ to 2 inches beyond the three segments 18, 20 and 22 constituting the inner or infant seat. A push-pull rod 23 has one end secured to the front end of frame 17 and emerges from the opening 24 in seat 14. A knob 26 is secured to the outer end of rod 23. Rear segment 18 is secured to frame 17 by rivets 19. The side segments 20 and 22 each are slotted to form slots 28 whose fronts are directed toward the rear of the seat and form a track for rollers 30 secured to the top of the respective sides of frame 17.

When the rod 24 is pulled, it will be observed that the segments 18, 20 and 22 will be brought inwardly to form an infant seat within the center of the adult seat. When the rod is pushed, the segments retract within the hollow part of the seat 12. Any intermediate position provides an allowance for the infant user to "grow into" the adult size seat.

Preferably, the ends of the segments have depending flanges slidably received in tracks 32 in the hollow of seat 12.

The operation and use of the invention hereinabove described will be evident to those skilled in the art to which it relates from a consideration of the foregoing.

It will thus be seen that there is provided a device in which the several objects of this invention are achieved, and which is well adapted to meet the conditions of practical use. Its advantages are easily seen.

It is thought that persons skilled in the art to which this invention relates will be able to obtain a clear understanding of the invention after considering the foregoing description in connection with the accompanying drawing. Therefore, a more lengthy description is deemed unnecessary.

It is to be understood that various changes in shape, size and arrangement of the elements of this invention as claimed may be resorted to in actual practice, if desired.

Having thus described the invention, what is claimed as new and to be secured by Letters Patent is:

1. A toilet seat adjustable for infant use comprising a main seat having a central circular opening; a hollow in said seat communicating with said opening and extending into said seat around said opening; a frame in said hollow; an axial opening in the front of said seat; a pull rod passing through said opening with its inward end secured to said frame; rear and side seat segments of an infant seat slidably received in said hollow and secured to said frame for movement into and out of said opening as said rod in pulled or pushed.

2. The invention as recited in claim 1, wherein said side seat segments have a slot directed toward the rear of said main seat; and rollers on said frame, each of said rollers fitting in the adjoining slot.

3. The invention as defined in claim 1, wherein said side segments have an arcuate shape with straight ends and said rear segment is rectangular.

* * * * *